US008390212B2

(12) United States Patent
Nishi

(10) Patent No.: US 8,390,212 B2
(45) Date of Patent: Mar. 5, 2013

(54) LIGHT-EMITTING ELEMENT DRIVING CONTROL CIRCUIT

(75) Inventor: Tomoaki Nishi, Nagaoka (JP)

(73) Assignees: Semiconductor Components Industries, LLC;, Phoenix, AZ (US); Sanyo Semiconductor Co., Ltd., Gunma (JP)

( * ) Notice: Subject to any disclaimer, the term of this patent is extended or adjusted under 35 U.S.C. 154(b) by 191 days.

(21) Appl. No.: 12/565,476

(22) Filed: Sep. 23, 2009

(65) Prior Publication Data

US 2010/0079082 A1 Apr. 1, 2010

(30) Foreign Application Priority Data

Sep. 24, 2008 (JP) ..... 2008-244589

(51) Int. Cl.
*H05B 41/16* (2006.01)

(52) U.S. Cl. ..... 315/291; 315/294; 315/297; 315/307; 323/282

(58) Field of Classification Search ..... 315/209 R, 315/291, 324
See application file for complete search history.

(56) References Cited

U.S. PATENT DOCUMENTS

| | | | | |
|---|---|---|---|---|
| 6,734,639 | B2 * | 5/2004 | Chang et al. | 315/291 |
| 2006/0290298 | A1 * | 12/2006 | Kang et al. | 315/291 |
| 2007/0210725 | A1 * | 9/2007 | Marosek | 315/291 |
| 2008/0048589 | A1 * | 2/2008 | Fukumoto et al. | 315/324 |

FOREIGN PATENT DOCUMENTS

JP 2006-230133 8/2006

* cited by examiner

*Primary Examiner* — Douglas W Owens
*Assistant Examiner* — Jonathan Cooper
(74) *Attorney, Agent, or Firm* — SoCal IP Law Group LLP; Steven C. Sereboff; John E. Gunther

(57) ABSTRACT

A light-emitting-element-driving-control circuit comprising: a control circuit to turn on or off a transistor based on an input-control signal, the transistor being connected in series with a light-emitting element and an inductor connected in series and controlling increase and decrease of a driving current of the light-emitting element; a maximum-value-detection circuit to detect a maximum value of the driving current; and a control-signal-generation circuit to generate the control signal for turning on the transistor to increase the driving current at a speed corresponding to a level of a power-supply voltage when the driving current is smaller than the maximum value and turning off the transistor to be kept for a predetermined period to decrease the driving current at a speed corresponding to a level of a forward voltage of the light-emitting element when the driving current reaches the maximum value, based on a detection result of the maximum-value-detection circuit.

2 Claims, 5 Drawing Sheets

LIGHT-EMITTING ELEMENT DRIVING CONTROL CIRCUIT

CROSS-REFERENCE TO RELATED APPLICATION

This application claims the benefit of priority to Japanese Patent Application No. 2008-244589, filed Sep. 24, 2008, of which full contents are incorporated herein by reference.

BACKGROUND OF THE INVENTION

1. Field of the Invention

The present invention relates to a light-emitting element driving control circuit.

2. Description of the Related Art

In order to efficiently drive an LED (Light Emitting Diode), which is recently used in various electronic equipment, an LED driving control circuit employing a switching control method might be used (See Japanese Patent Laid-Open Publication No. 2006-230133, for example.)

FIG. 4 is an example of the LED driving control circuit for controlling driving of a white LED for illumination. An LED driving control circuit 100 performs switching for an NMOS transistor 300 to control a driving current Is of white LEDs 310 to 319 (hereinafter referred to as LEDs 310 to 319.) The LED driving control circuit 100 includes a pulse generation circuit 200, a comparator 210, a reference voltage circuit 220, and an SR flip-flop 230.

The pulse generation circuit 200 generates an output signal Vp including a pulse of a high level (hereinafter referred to as H level) in every predetermined cycle TA.

The comparator 210 detects whether or not the driving current Is has reached a predetermined current value I1. Specifically, the comparator 210 compares a detection voltage Vs, which is generated at one end of a detection resistor 340 and generated according to a current value of the driving current Is, with a reference voltage Vref of a reference voltage circuit 220. When the detection voltage Vs becomes higher than the reference voltage Vref, it is considered that the driving current Is has reached the predetermined current value I1, and the comparator 210 changes an output signal Vc from a low level (hereinafter referred to as L level) to the H level.

The SR flip-flop 230 changes a Q output to the H level to turn on the NMOS transistor 300 when the output signal Vp from the pulse generation circuit 200 is changed to the H level. On the other hand, the SR flip-flop 230 changes the Q output to the L level to turn off the NMOS transistor 300 when the output signal Vc of the comparator 210 is change to the H level.

A change of the driving current Is will now be described referring to an upper side of a timing chart shown in FIG. 5. First, when the output signal Vp is changed to the H level at a time T0, the Q output of the SR flip-flop 230 is changed to the H level, and thus, the NMOS transistor 300 is turned on. As a result, the driving current Is is increased at a speed corresponding to an inductance L of an inductor 320 and a level of a power supply voltage VDD. Since the driving current Is is supplied to the detection resistor 340 through the NMOS transistor 300 which has been turned on, the detection voltage Vs is also raised according to the increase of the driving current Is. When the current value of the driving current Is becomes equal to the predetermined current value I1 at a time T1, that is, when the detection voltage Vs becomes equal to the reference voltage Vref, the output signal Vc of the comparator 210 is changed to the H level, and thus, the Q output of the SR flip-flop 230 is changed to the L level. As a result, the NMOS transistor 300 is turned off, and the energy stored in the inductor 320 is released through a loop of the LEDs 310 to 319, the inductor 320, and a diode 330. The energy stored in the inductor 320 is released by the driving current Is at a speed corresponding to the inductance L and respective levels of forward voltages of the LEDs 310 to 319 and the diode 330. As above, the predetermined current value I1 is the maximum value of the driving current Is, and the LED driving control circuit 100 controls the NMOS transistor 300 so that the driving current Is does not exceed the maximum value. Since the driving current Is is decreased at the time T1, the output signal Vc of the comparator 210 is changed to the L level.

At a time T3 at which one cycle of the output signal Vp has elapsed from the time T0, the output signal Vp of the pulse generation circuit 200 is changed to the H level, and thus, the NMOS transistor 300 is turned on and the driving current Is is increased as in the case with the time T0. In this way, a change from the time T0 to the time T3 is repeated at the time T3 and thereafter. Since the driving current Is is changed in the cycle TA, an average value of the driving current Is is a predetermined value, and thus, the LEDs 310 to 319 are driven by a constant current. If the power supply voltage VDD is increased and the speed of increase of the driving current Is is increased, for example, a period of ON-time of the NMOS transistor 300 is reduced, but a cycle during which the transistor 300 is turned on is not changed. That is, the LED driving control circuit 100 is a switching circuit, which employs a pulse-width modulation method, for changing a pulse width of ON-time when the NMOS transistor 300 is turned on in the cycle TA.

As described above, the LED driving control circuit 100 performs switching for the NMOS transistor 300 in the cycle TA so that the LEDs 310 to 319 are driven by a constant current. As a result, the cycle of the driving current Is also becomes equal to the cycle TA similarly to a switching cycle.

However, as shown in a lower side of the timing chart in FIG. 5, when the driving current Is, which is changed in the cycle TA before the time T0, is reduced due to transitional fluctuations of the power supply voltage VDD, for example, the cycle of the driving current Is does not become equal to the cycle TA even if the power supply voltage VDD is not changed from a desired level at the time T0 and thereafter. Specifically, when the NMOS transistor 300 is turned on at the time T0, the actual driving current Is indicated by a solid line is increased at a speed equivalent to the speed of increase of the driving current Is in the cycle TA indicated by a dotted line, that is, the speed corresponding to the inductance L of the inductor 320 and the level of the power supply voltage VDD. As a result, the actual driving current Is reaches the current value I1 at the time T2 later than the above-mentioned time T1. Then, when the NMOS transistor 300 is turned off at the time T2, the actual driving current Is is decreased at a speed equivalent to the speed of decrease of the driving current Is in the cycle TA, that is, the speed corresponding to the inductance L and the forward voltage level of the LEDs 310 to 319 and the diode 330. At the time T3 at which the output signal Vp is changed to the H level, the NMOS transistor 300 is turned on, and thus, the actual driving current Is is increased. Since the actual driving current Is at the time T3 is greater in current value than the driving current Is in the cycle TA, the actual driving current Is reaches the current value I1 at a time T4 earlier than a time T5. When the NMOS transistor 300 is turned off at the time T4, the actual driving current Is is decreased until a time T6 at which one cycle of the output signal Vp has elapsed from the time T3. The actual driving current Is at the time T6 is much lower in current value than the driving current Is in the cycle TA. Therefore, even if the NMOS transistor 300 is turned on at the time T6, the actual driving current Is will not reach the current value I1 by a time T7 at which one cycle of the output signal Vp has elapsed from the time T6, but reaches the current value I1 at a time T8 within a period from the time T7 to the time at which one cycle of the output signal Vp has elapsed.

As described above, even if the switching cycle TA of the NMOS transistor 300, the speed of increase and the speed of decrease of the driving current Is, and the current value I1 for detecting the maximum value of the driving current Is are constant, the cycle of the actual driving current Is may not be equal to the cycle TA. That is, when the NMOS transistor 300 is turned on in the cycle TA and the maximum value of the driving current Is is detected to control the driving current Is as mentioned above, sub-harmonic oscillation which oscillates in a cycle longer than the cycle TA may be generated.

SUMMARY OF THE INVENTION

A light-emitting element driving control circuit according to an aspect of the present invention, comprises: a control circuit configured to turn on or off a transistor based on an input control signal, the transistor being connected in series with a light-emitting element and an inductor connected in series, the transistor being configured to control increase and decrease of a driving current of the light-emitting element; a maximum-value detection circuit configured to detect a maximum value of the driving current; and a control signal generation circuit configured to generate the control signal for turning on the transistor to increase the driving current at a speed corresponding to a level of a power supply voltage when the driving current is smaller than the maximum value and turning off the transistor to be kept for a predetermined period to decrease the driving current at a speed corresponding to a level of a forward voltage of the light-emitting element when the driving current reaches the maximum value, based on a detection result of the maximum-value detection circuit.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Figure 1:
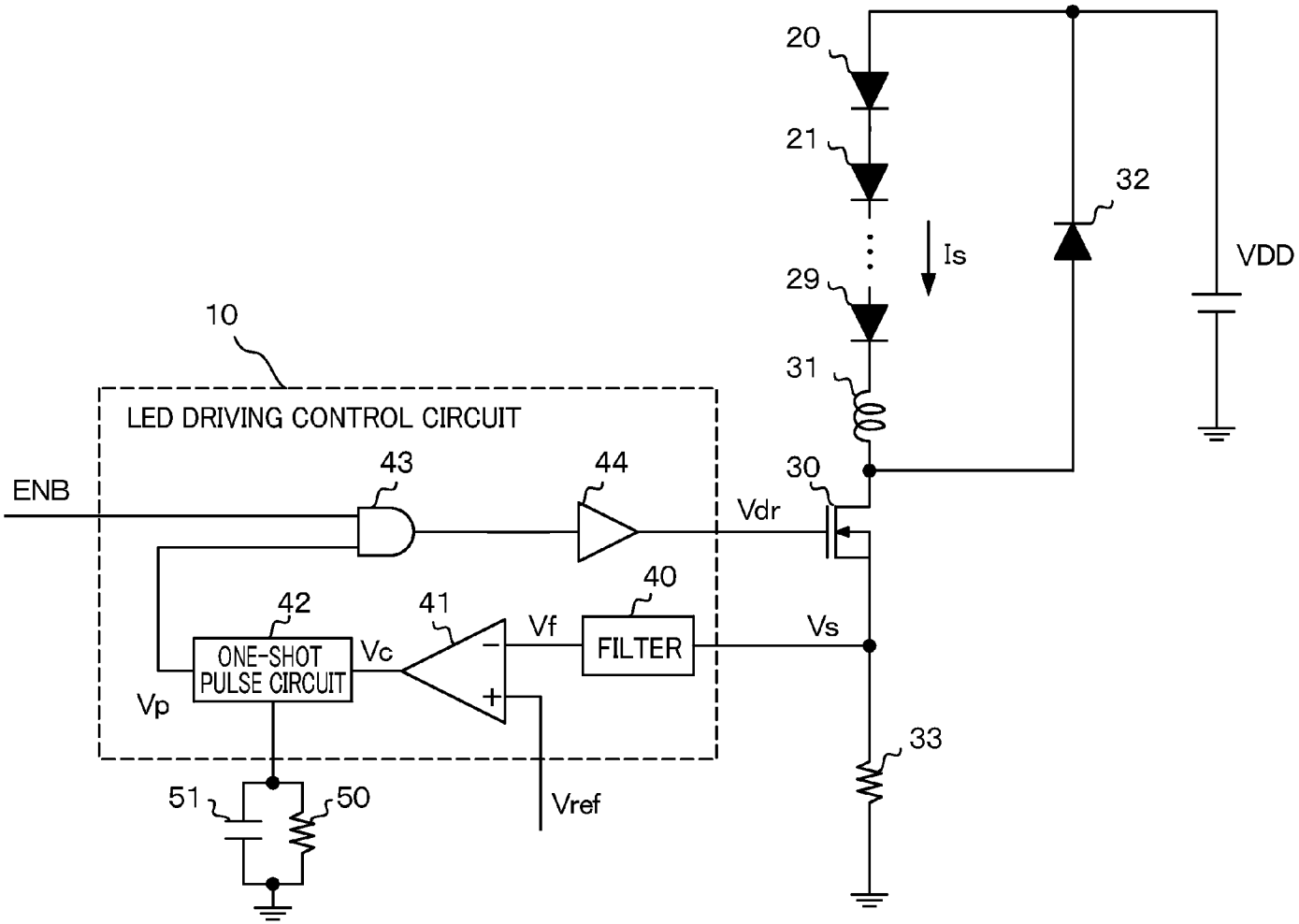
FIG. 1 is a diagram illustrating a configuration of an LED driving control circuit 10 according to an embodiment of the prevent invention.

FIG. 1 is a diagram illustrating a configuration of an LED driving control circuit 10 according to an embodiment of the present invention. The LED driving control circuit 10 controls switching of an NMOS transistor 30 so that white LEDs 20 to 29 for illumination (hereinafter referred to as LEDs 20 to 29) are driven by a desired constant current, for example.

The LEDs 20 to 29 are 10 pieces of white LEDs connected in series, in which an anode of the LED 20 is connected to a power supply voltage VDD and a cathode of the LED 29 is connected to one end of an inductor 31. It is assumed that each forward voltage of the LEDs 20 to 29 according to an embodiment of the present invention is 3V, for example. Also, it is assumed that the power supply voltage VDD according to an embodiment of the present invention is at a sufficiently high level so that the ten LEDs 20 to 29 can be driven.

The NMOS transistor 30 controls increase and decrease of the driving current Is for driving the LEDs 20 to 29 with use of the inductor 31 and a diode 32. Specifically, when the NMOS transistor 30 is turned on, the driving current Is is increased at a speed corresponding to an inductance L of the inductor 31 and the power supply voltage VDD. Since the voltage across the inductor 31 is changed according to a difference between the power supply voltage VDD and the sum of the respective forward voltages of the LEDs 20 to 29, that is 30V, a speed of increase in the driving current Is, i.e., S1=dIs/dt, is changed according to (VDD−30)/L. That is, the speed of increase S1 of the driving current Is according to an embodiment of the present invention is increased according to rise in level of the power supply voltage VDD. When the NMOS transistor 30 is turned on, energy corresponding to the current value of the driving current Is is stored in the inductor 31. Therefore, when the NMOS transistor 30 is turned off, the energy stored in the inductor 31 is released through a loop of the LEDs 20 to 29, the inductor 31, and the diode 32. In this case, the driving current Is is decreased at a speed corresponding to the sum of the inductance L and the forward voltages of the LEDs 20 to 29 and the diode 32. Here, assuming that the forward voltage of the diode 32 is 1V, for example, the voltage across the inductor 31 is equal to 31V, which is the sum of 30V, i.e., the sum of the forward voltages of the LEDs 20 to 29, and the above-mentioned 1V. That is, a speed of decrease in the driving current Is when the NMOS transistor 30 is turned off, i.e., S2=dIs/dt, is changed according to 31/L. Moreover, since the inductance L of the inductor 31 according to an embodiment of the present invention is constant in value, the speed of decrease S2 of the driving current Is is constant regardless of the level of the power supply voltage VDD.

A detection resistor 33 detects a current value of the driving current Is when the NMOS transistor 30 is turned on and is provided between a source of the NMOS transistor 30 and a ground GND. In an embodiment according to the present invention, it is assumed that a voltage generated at one end of the detection resistor 33 according to the current value of the driving current Is is a detection voltage Vs. Therefore, a speed of increase in the detection voltage Vs is equal to the speed of increase S1 in the above-mentioned driving current Is. When the NMOS transistor 30 is turned off, the driving current Is does not flow through the detection resistor 33, and thus, the detection voltage Vs becomes equal to the ground GND level.

Circuits making up the LED driving control circuit 10 will now be described in outline. The LED driving control circuit 10 includes a filter 40, a comparator 41, a one-shot pulse circuit 42, an AND circuit 43, and a buffer circuit 44. The LED driving control circuit 10 according to an embodiment of the present invention is assumed to be integrated. The filter 40 and the comparator 41 (comparison circuit) correspond to a maximum-value detection circuit according to the present invention, and the AND circuit 43 and the buffer circuit 44 correspond to a control circuit according to the present invention.

The filter 40 suppresses noise of the detection voltage Vs generated at one end of the detection resistor 33 and outputs the voltage as an output voltage Vf. Since parasitic capacitance (not shown) is present in the inductor 31 according to an embodiment of the present invention, when the NMOS transistor 30 is turned on, electrical charge charged in the parasitic capacitance of the inductor 31 is discharged into the detection resistor 33 through the NMOS transistor 30. Thus, a surge current corresponding to a capacitance value of the parasitic capacitance transitionally flows through the detection resistor 33, and a surge voltage is generated as noise in the detection resistor 33. The filter 40 according to an embodiment of the present invention is assumed to be a low-pass filter for which such a time constant is set that the surge voltage is suppressed and the detection voltage Vs, which changes at the speed of increase S1, is output as an output voltage Vf.

The comparator 41 detects whether or not the driving current Is has reached a predetermined current value I1. Specifically, the comparator 41 compares the output voltage Vf output from the filter 40 and a reference voltage Vref output from a microcomputer (not shown), for example. When the output voltage Vf becomes higher than the reference voltage Vref, it is considered that the driving current Is has reached the predetermined current value I1, and an output signal Vc of the comparator 41 is changed from the H level to the L level.

The one-shot pulse circuit 42 (control signal generation circuit) changes an output signal Vp (control signal) to the L level to be kept only for a predetermined period Tx corresponding to a resistance value of a resistor 50 and a capacitance value of a capacitor 51 when the output signal Vc of the comparator 41 is changed to the L level. That is, the one-shot pulse circuit 42 generates a pulse of the L level only for the predetermined period Tx when the output signal Vc is changed to the L level.

The AND circuit 43 changes an output based on the output signal Vp so as to perform the switching for the NMOS transistor 30 when an enable signal ENB output from the microcomputer (not shown) is at the H level, and outputs a signal for stopping the switching of the NMOS transistor when the enable signal ENB is at the L level. Specifically, when the enable signal ENB is at the H level, the output signal Vp is output as an output of the AND circuit 43, and when the enable signal is at the L level, the signal of the L level is output.

The buffer circuit 44 directly drives the NMOS transistor 30 based on the output from the AND circuit 43. Specifically, when the output from the AND circuit 43 is at the H level, a driving signal Vdr at the H level is output so as to turn on the NMOS transistor 30. On the other hand, when the output from the AND circuit 43 is at the L level, the driving signal Vdr at the L level is output so as to turn off the NMOS transistor 30.

Figure 2:
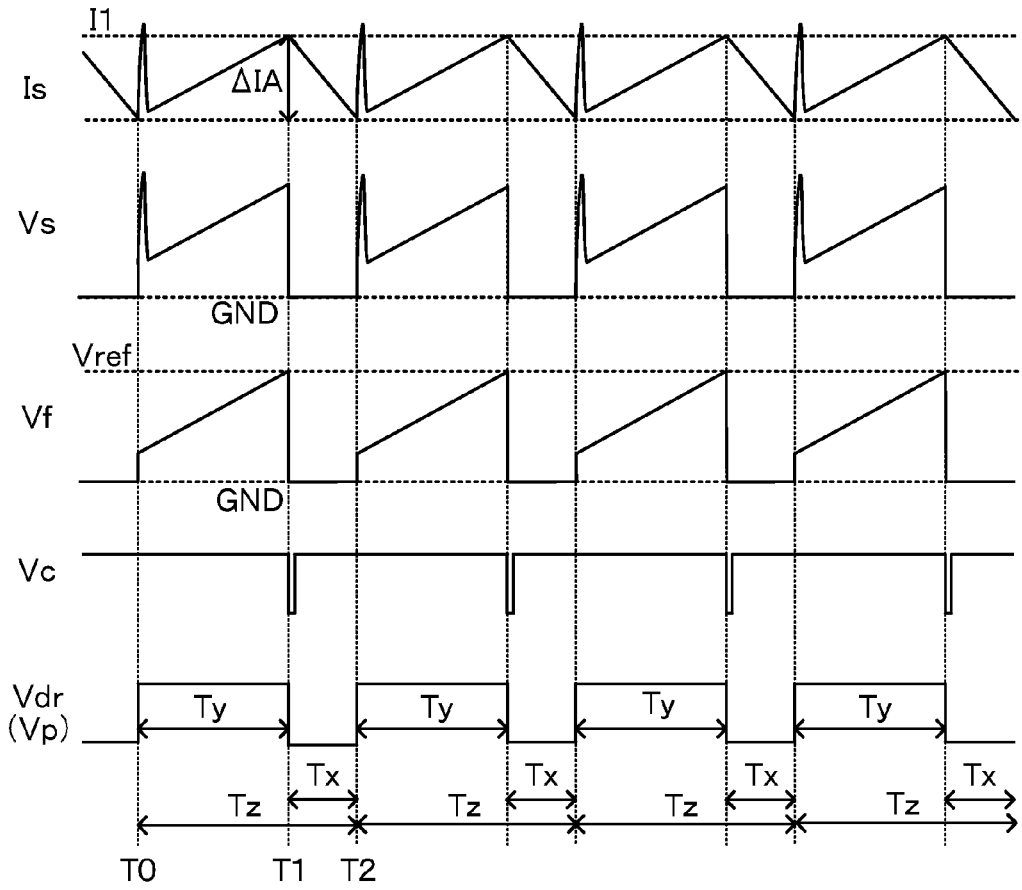
FIG. 2 is a timing chart for explaining an example of an operation of an LED driving control circuit 10.

There will now be described an example of an operation of the LED driving control circuit 10 when the LEDs 20 to 29 are driven by a constant current, referring to a timing chart shown in FIG. 2. It is assumed here that pulse generation in the one-shot pulse circuit 42 is finished and the output signal Vp is changed from the L level to the H level at a time T0. Hereinafter, it is also assumed that the enable signal ENB output from the microcomputer (not shown) is at the H level and the power supply voltage VDD is 33V. Thus, when the NMOS transistor 30 is turned on, the speed of increase S1=dIs/dt of the driving current Is is changed according to (33−30)/L=3/L. On the other hand, the speed of decrease S2=dIs/dt of the driving current Is when the NMOS transistor 30 is turned off is changed according to 31/L as described above. Therefore, in an embodiment according to the present invention, the speed of decrease S2 of the driving current Is is faster than the speed of increase S1.

First, when the one-shot pulse circuit 42 changes the output signal Vp to the H level at the time T0, the output of the AND circuit 43 is changed to the H level, and as a result, the driving signal Vdr is also changed to the H level. Thus, the NMOS transistor 30 is turned on. When the NMOS transistor 30 is turned on, the surge current is superimposed on the driving current Is due to influence of the parasitic capacitance of the inductor 31. As a result, the surge voltage is generated as noise in the detection voltage Vs at one end of the detection resistor 33. As described above, the filter 40 suppresses the surge voltage in the detection voltage Vs as well as increases the output voltage Vf at the same speed as the speed of increase S1 of the detection voltage Vs. When the driving current Is is increased to reach the current value I1 at a time T1, that is, when the output voltage Vf of the filter 40 reaches the reference voltage Vref, the comparator 41 changes the output signal Vc to the L level. When the output signal Vc is changed to the L level, the one-shot pulse circuit 42 changes the output signal Vp to the L level, and thus, the output of the AND circuit 43 is changes to the L level and the driving signal Vdr of the buffer circuit 44 is changes to the L level as well. As a result, at the time T1, the NMOS transistor 30 is turned off. When the NMOS transistor 30 is turned off, the inductor 31 releases the energy accumulated by the driving current Is through the loop of the LEDs 20 to 29, the inductor 31, and the diode 32, and thus, the driving current Is is decreased at the speed of decrease S2. The current flowing through the detection resistor 33 at the time T1 becomes equal to zero, and the detection voltage Vs becomes equal to the ground GND level. Since the one-shot pulse circuit 42 stops generating a pulse at a time T2 at which the predetermined period Tx has elapsed from the time T1, the output signal Vp is changed to the H level. Since the output of the AND circuit 43 is changed to the H level based on the output signal Vp of the H level, the driving signal Vdr of the buffer circuit 44 is changed to the H level as well. Therefore, at the time T2, the NMOS transistor 30 is turned on, and the driving current Is is increased at the speed of increase S1. At the time T2 and thereafter, the operation from the time T0 to the time T2 is repeated.

As described above, the period Tx, during which the NMOS transistor 30 is off and the driving current Is is decreased, and the speed of decrease S2 are constant. Therefore, an amount is also constant of change ΔIA of the driving current Is when decreasing at the speed of decrease S2 only for the period Tx. When the power supply voltage VDD is constant in level, the speed of increase S1 of the driving current Is is constant, and thus, the period is also constant during which the driving current Is is changed by ΔIA at the speed of increase S1. Therefore, the LED driving control circuit 10 according to an embodiment of the present invention can change the driving current Is in a predetermined cycle based on the speed of increase S1, the speed of decrease S2, and the period Tx. In an embodiment according to the present invention, when the supply voltage VDD is 33V, the period is referred to as a period Ty during which the driving current Is is changed by ΔIA at the speed of increase S1, and a cycle of the driving current Is is referred to as a cycle Tz. Since the driving current Is is changed in the predetermined cycle Tz as above, an average value of the driving current Is is a predetermined value, and thus, the LEDs 20 to 29 are driven by a constant current.

Figure 3:
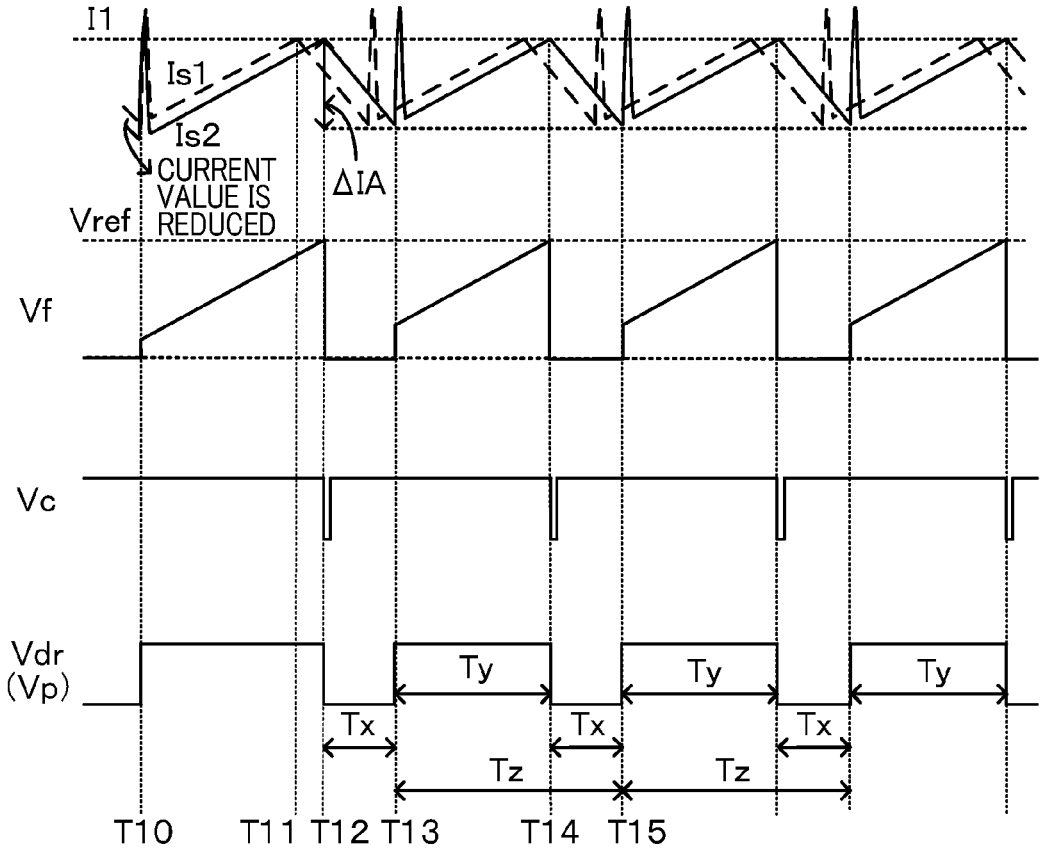
FIG. 3 is a timing chart for explaining an example of an operation of an LED driving control circuit 10.
Figure 4:
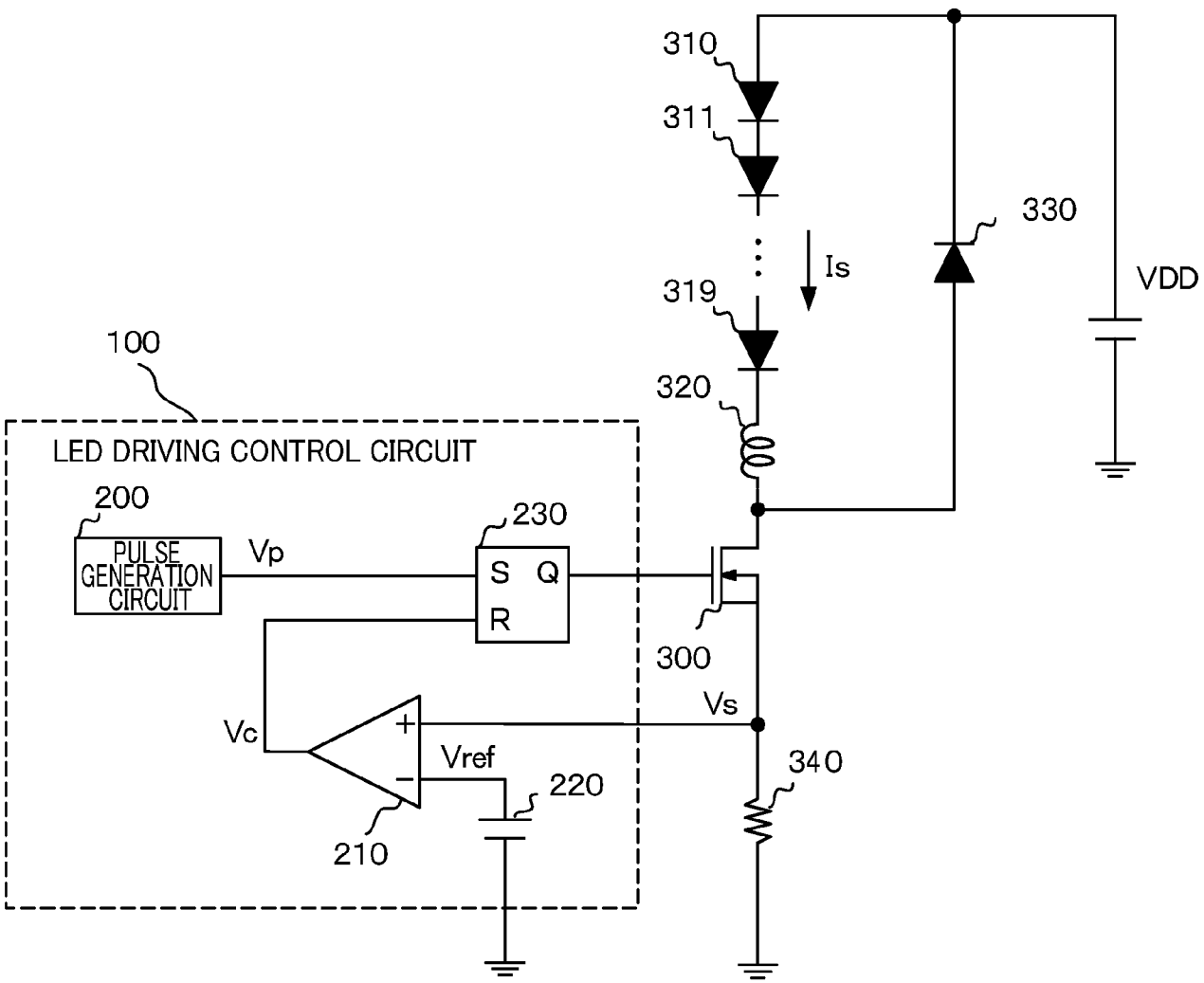
FIG. 4 is a diagram illustrating a configuration of an LED driving control circuit 100.
Figure 5:
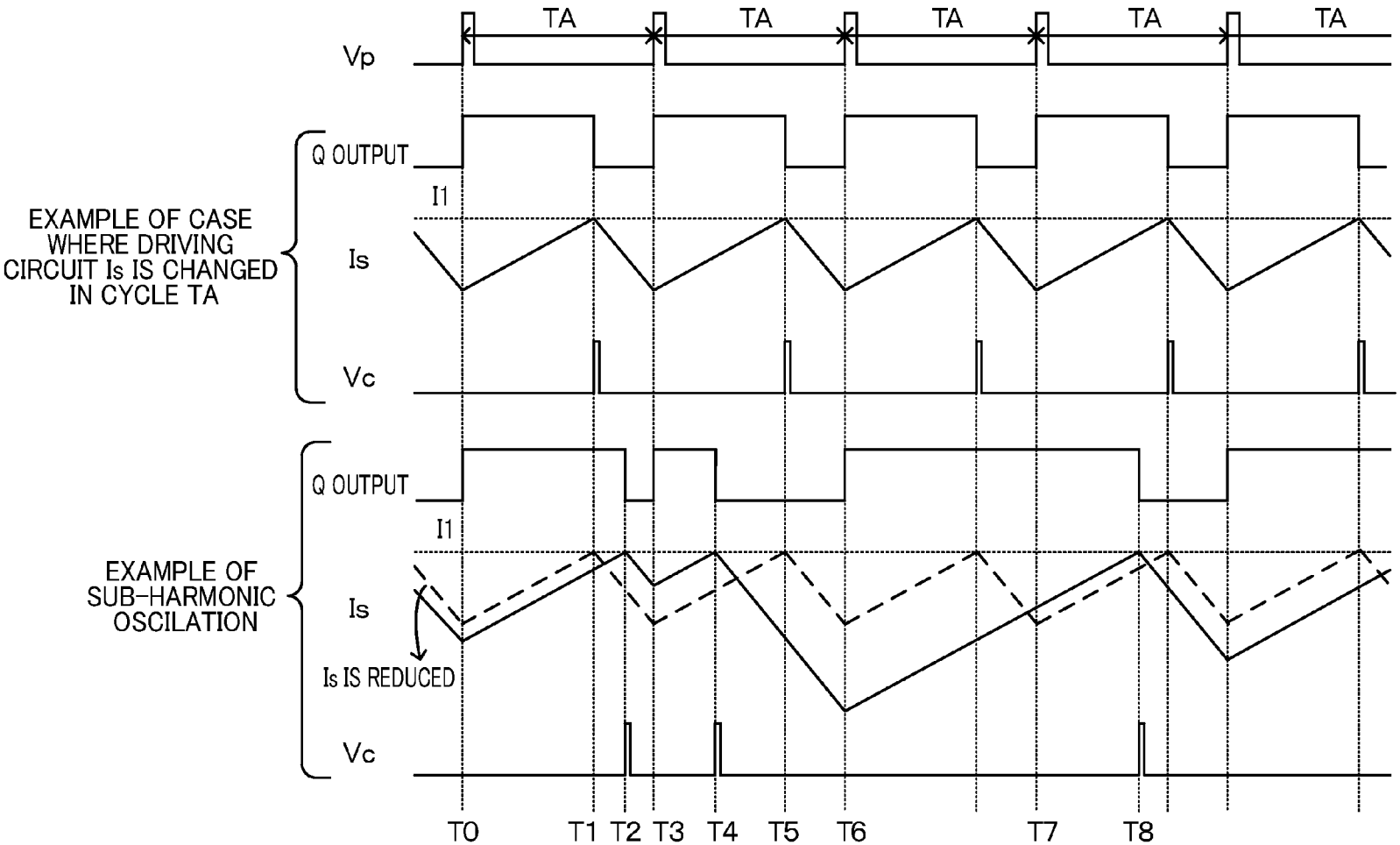
FIG. 5 is a timing chart for explaining an example of an operation of an LED driving control circuit 100.

There will now be described an example of an operation of the LED driving control circuit 10 when the power supply voltage VDD is transitionally fluctuated and the current value of the driving current Is, which changes in the cycle Tz, is changed, for example, referring to a timing chart shown in FIG. 3. Here, it is assumed that pulse generation of the one-shot pulse circuit 42 is finished and the output signal Vp is changed from the L level to the H level at a time T10. A waveform shown by a broken line in an upper side in FIG. 3 indicates a driving current Is1, which changes in the cycle Tz, and a waveform shown by a solid line indicates a driving current Is2 whose current value is reduced to be lower than the driving current Is1 due to transitional fluctuations of the power supply voltage VDD, for example, before the time T10. It is also assumed that the power supply voltage VDD is 33V and constant at the time T10 and thereafter. That is, it is assumed that the speed of increase S1 and the speed of decrease S2 of the driving currents Is1 and Is2 are not changed at the time T10 and thereafter.

When the one-shot pulse circuit 42 changes the output signal Vp to the H level at the time T10, the driving signal Vdr is also changed to the H level, and thus, the NMOS transistor 30 is turned on. As a result, the driving current Is2 on which the surge current is superimposed flows through the detection resistor 33. The filter 40 suppresses the surge voltage of the detection voltage Vs and increases the output voltage Vf at the speed of increase S1. A current value of the driving current Is2 at the time T10 is smaller than the driving current Is1 when there are no transitional fluctuations in the power supply voltage VDD. Therefore, at a time T12 later than a time T11 at which the driving current Is1 reaches the current value I1, the driving current Is2 reaches the current value I1. When the driving current Is2 reaches the current value I1, the comparator 41 changes the output signal Vc to the L level, and thus, the one-shot pulse circuit 42 changes the output signal Vp to the L level to be kept only for the predetermined period Tx so as to turn off the NMOS transistor 30. Therefore, the driving current Is2 is decreased at the speed of decrease S2 until a time T13 at which the period Tx has elapsed from the time T12. An amount of decrease of the driving current Is2 from the time T12 to the time T13 is equal to the above-mentioned amount of change ΔIA, since the speed of decrease S2 and the period Tx are constant. At the time T13, the one-shot pulse circuit 42 stops the pulse generation to change the output signal Vp to the H level. Thus, the NMOS transistor 30 is turned on, and the driving current Is2 is increased at the speed of increase S1. The period until when the driving current Is2 reaches the current value I1 again is determined according to the above-mentioned amount of change ΔIA and the speed of increase S1. At the time T10 and thereafter, since the power supply voltage VDD is assumed to be constant, the period until when the driving current Is2 reaches the current value I1 again is equal to the above-mentioned period Ty. At a time T14, at which the period Ty has elapsed from the time T13, the driving current Is2 reaches the current value I1, and thus, the one-shot pulse circuit 42 changes the output signal Vp to the L level. The operation of the LED driving control circuit 10 from the time T14 to a time T15 at which the period Tx has elapsed is the same as the operation from the time T12 to the time T13. Also, the operation from the time T13 to the time T15 is repeated at the time T15 and thereafter. Therefore, even if the power supply voltage VDD is transitionally fluctuated and the driving current Is2 having a current value lower than the driving current Is1 is generated, for example, the LED driving control circuit 10 can continue to change the driving current Is2 in the cycle Tz. Even if the driving current I2 is increased to become greater than the driving current I1 before the time T10, for example, since the amount of change ΔIA of the driving current Is2 and the speed of increase S1 of the driving current Is2 are constant, the LED driving control circuit 10 can continue to change the driving current Is2 in the cycle Tz.

In the LED driving control circuit 10 according to an embodiment of the present invention with a configuration described above, the comparator 41 detects that the driving current Is reaches the current value I1, which is the predetermined maximum value. The one-shot pulse circuit 42 outputs the output signal Vp of the H level so as to turn on the NMOS transistor 30 based on the output signal Vp of the comparator 41 when the driving current Is is smaller than the current value I1. When the driving current Is reaches the current value I1, the output signal Vp of the L level is output for the period Tx so as to turn off the NMOS transistor 30. Since the speed of decrease S2 of the driving current Is and the period Tx when the NMOS transistor 30 is turned off are constant, the amount of change ΔIA of the driving current Is is constant. Moreover, when the power supply voltage VDD is constant in level, the speed of increase S1 of the driving current Is is constant, and thus, the period is also constant during which the driving current Is is changed by ΔIA at the speed of increase S1. Therefore, the LED driving control circuit 10 according to an embodiment of the present invention can change the driving current Is in the predetermined cycle Tz, and can suppress subharmonic oscillation. In general, in a circuit that detects a maximum value of a driving current of a load such as an LED and controls increase and decrease of the driving current by performing switching of a transistor, slope compensation for imparting predetermined inclination to the maximum value of the driving current may be performed in order to suppress the subharmonic oscillation. In an embodiment according to the present invention, there is no need to use a circuit for compensating the slope as above in order to suppress the subharmonic oscillation, thereby preventing a configuration of the LED driving control circuit 10 from becoming complicated.

Moreover, in an embodiment according to the present invention, the one-shot pulse circuit 42 is employed in order to bring the output signal Vp to the L level only for the period Tx. Thus, it is possible to reliably bring the output signal Vp to the L level only for the period Tx when the comparator 41 detects that the driving current Is has reached the current I1. That is, in an embodiment according to the present invention, every time the driving current Is reaches the current value I1, the driving current Is can be reliably decreased in current amount by ΔIA. Therefore, if the speed of increase S1 of the driving current Is is constant, the cycle of the driving current Is can be made constant.

Furthermore, in an embodiment according to the present invention, the detection voltage Vs is processed in the filter 40, to be output as the output voltage Vf to the comparator 41. In a configuration without the filter 40, if the surge voltage becomes so great that the detection voltage Vs exceeds the level of the reference voltage Vref, there might occur such a malfunction that the output signal Vc is changed to the L level even if the driving current Is has not reached the maximum value yet. In an embodiment according to the present invention, noise caused by the surge voltage of the detection voltage Vs is suppressed by the filter 40 when the maximum value of the driving current Is is detected, and thus, the malfunction can be prevented.

The above embodiments of the present invention are simply for facilitating the understanding of the present invention and are not in anyway to be construed as limiting the present invention. The present invention may variously be changed or altered without departing from its spirit and encompass equivalents thereof.

In an embodiment according to the present invention, the NMOS transistor 30 is employed in order to suppress increase and decrease of the driving current Is, however, an NPN transistor may be employed, for example.

Moreover, in an embodiment according to the present invention, the inductor 31 is provided between the cathode of the LED 29 and a drain of the NMOS transistor 30, however, the inductor may be provided between the power supply voltage VDD and the anode of the LED 20.

Furthermore, in an embodiment according to the present invention, the diode 32 is provided in order to regenerate the driving current Is when the NMOS transistor 30 is turned off, however, this is not limitative. The same effect can be obtained as in an embodiment according to the present invention by providing a switch circuit that is turned on or off in a complementary manner with the NMOS transistor 30 instead of the diode 32, for example.

What is claimed is:

1. A light-emitting element driving control circuit comprising:

a control circuit configured to turn on or off a transistor based on an input control signal, the transistor being connected in series with a light-emitting element and an inductor connected in series, the transistor being configured to control increase and decrease of a driving current of the light-emitting element;

a maximum-value detection circuit configured to detect a maximum value of the driving current; and a control signal generation circuit configured to generate the control signal for turning on the transistor to increase the driving current at a speed corresponding to a level of a power supply voltage when the driving current is smaller than the maximum value and turning off the transistor for a predetermined period to decrease the driving current at a speed corresponding to a level of a forward voltage of the light-emitting element when the driving current reaches the maximum value, wherein the control circuit is configured to turn on the transistor when the control signal becomes one logic level and turn off the transistor when the control signal becomes the other logic level; and the control signal generation circuit is a one-shot pulse circuit configured to output a pulse signal of one logic level as the control signal when the driving current is smaller than the maximum value and output the pulse signal of the other logic level as the control signal for the predetermined period when the driving current reaches the maximum value, wherein the turning on and turning off of the transistor is based on the detection result of the maximum-value detection circuit.

2. The light-emitting element driving control circuit according to claim 1, wherein the maximum-value detection circuit includes a filter configured to suppress noise in a detection voltage generated at one end of a resistor, the detection voltage corresponding to a current value of the driving current; and a comparison circuit configured to output a result of comparison between the detection voltage with the noise suppressed and a reference voltage corresponding to the maximum value, as the detection result of the maximum-value detection circuit.

* * * * *